US010047647B2

(12) United States Patent
Hiramatsu et al.

(10) Patent No.: US 10,047,647 B2
(45) Date of Patent: Aug. 14, 2018

(54) VARIABLE VALVE MECHANISM OF INTERNAL COMBUSTION ENGINE

(71) Applicants: OTICS CORPORATION, Nishio-shi (JP); TOYOTA JIDOSHA KABUSHIKI KAISHA, Toyota-shi (JP)

(72) Inventors: Naoki Hiramatsu, Nishio (JP); Masatoshi Sugiura, Nishio (JP); Koki Yamaguchi, Nishio (JP); Motohiro Yuge, Toyota (JP)

(73) Assignees: OTICS CORPORATION, Nishio-Shi, Aichi-Ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 109 days.

(21) Appl. No.: 15/173,418

(22) Filed: Jun. 3, 2016

(65) Prior Publication Data

US 2017/0016361 A1 Jan. 19, 2017

(30) Foreign Application Priority Data

Jul. 14, 2015 (JP) ..... 2015-140852

(51) Int. Cl.

| | |
|---|---|
| ***F01L 1/34*** | (2006.01) |
| ***F01L 13/00*** | (2006.01) |
| ***F01L 1/26*** | (2006.01) |

(52) U.S. Cl.

CPC ..... *F01L 13/0063* (2013.01); *F01L 1/267* (2013.01); *F01L 2013/001* (2013.01); *F01L 2105/00* (2013.01)

(58) Field of Classification Search

CPC ..... F01L 13/0015; F01L 13/0078; F01L 13/0063; F01L 13/001; F01L 2105/00; F01L 1/267

See application file for complete search history.

(56) References Cited

U.S. PATENT DOCUMENTS

2005/0247278 A1* 11/2005 Koshimizu ..... F01L 1/022 123/90.16

FOREIGN PATENT DOCUMENTS

JP 2001-263015 A 9/2001

* cited by examiner

*Primary Examiner* — Zelalem Eshete

(74) *Attorney, Agent, or Firm* — McGinn I.P. Law Group, PLLC.

(57) ABSTRACT

In a variable valve mechanism of an internal combustion engine, when a slider is displaced relative to an input member and an output member in an axial direction, the output member turns relative to the input member in a swing direction, whereby a lift of a valve is increased or reduced. The variable valve mechanism is brought into a lift retaining state when the slider is placed in an idle running range located on a reducing direction side with respect to a boundary position. The lift retaining state is a state where when the slider is displaced in the axial direction, the input member and the output member are displaced together with the slider in the axial direction, so that the relative displacement of the slider and the relative turning of the output member do not occur and the lift of the valve is retained.

10 Claims, 9 Drawing Sheets

VARIABLE VALVE MECHANISM OF INTERNAL COMBUSTION ENGINE

TECHNICAL FIELD

The present invention relates to variable valve mechanisms that drive valves of an internal combustion engine and change the drive state of the valves according to the operating condition of the internal combustion engine.

BACKGROUND ART

An example of such variable valve mechanisms is a variable valve mechanism group 90 of a conventional example developed by the applicant (Patent Document 1). This variable valve mechanism group 90 is shown in FIG. 9. The variable valve mechanism group 90 includes one variable valve mechanism 90B for each cylinder 6 of an internal combustion engine.

Each variable valve mechanism 90B includes an input member 92 and output members 93, and the input member 92 and the output members 93 are swingably arranged on the same axis. The output members 93 drive valves 7 when the input member 92 is driven by a cam.

Each variable valve mechanism 90B further includes a slider 94 that engages with the input member 92 and the output members 93. When the slider 94 is displaced relative to the input member 92 and the output members 93 in the axial direction p, q, the output members 93 turn relative to the input member 92 in the swing direction due to the engagement of the slider 94 with the input member 92 and the output members 93.

The variable valve mechanism group 90 further includes a displacement device 96. The displacement device 96 displaces the sliders 94 of the variable valve mechanisms 90B at a time in the axial direction p, q to cause the displacement of each slider 94 relative to the input member 92 and the output members 93 and the turning of the output members 93 relative to the input member 92. The lift of the valves 7 of each cylinder 6 is increased or reduced accordingly.

CITATION LIST

Patent Document

[Patent Document 1] Japanese Patent Application Publication No. 2001-263015

SUMMARY OF INVENTION

Technical Problem

In this variable valve mechanism group 90, however, the displacement device 96 displaces the sliders 94 of the variable valve mechanisms 90B at a time in the axial direction p, q. The variable valve mechanism group 90 therefore cannot individually control the variable valve mechanisms 90B and thus cannot deactivate only a predetermined cylinder 6. For improved fuel economy and engine performance, however, it is preferable that the variable valve mechanism group be able to deactivate only the predetermined cylinder.

It is an object of the present invention to make it possible to deactivate only a predetermined cylinder.

Solution to Problem

In order to achieve the above object, a variable valve mechanism of an internal combustion engine according to the present invention is configured as follows. The variable valve mechanism of an internal combustion engine includes an input member and an output member which are swingably disposed on a same axis, so that the output member drives a valve when the input member is driven by a cam; a slider that engages with the input member and the output member, so that when the slider is displaced relative to the input member and the output member in an axial direction as a longitudinal direction of the axis, the output member turns relative to the input member in a swing direction due to the engagement; and a displacement device that displaces the slider, so that when the displacement device displaces the slider in an increasing direction, or toward one side in the axial direction, the relative displacement of the slider occurs toward the one side in the axial direction and the relative turning of the output member occurs toward one side in the swing direction, whereby a lift of the valve is increased, and when the displacement device displaces the slider in a reducing direction, or toward the other side in the axial direction, the relative displacement of the slider occurs toward the other side in the axial direction and the relative turning of the output member occurs toward the other side in the swing direction, whereby the lift of the valve is reduced. The variable valve mechanism is brought into a variable state when the slider is placed in a normal range located on an increasing direction side with respect to a predetermined boundary position, and is brought into a lift retaining state when the slider is placed in an idle running range located on a reducing direction side with respect to the boundary position. The variable state is a state where even when the slider is displaced in the axial direction, the input member and the output member are not displaced together with the slider in the axial direction, so that the relative displacement of the slider and the relative turning of the output member occur and the lift of the valve is changed. The lift retaining state is a state where when the slider is displaced in the axial direction, the input member and the output member are displaced together with the slider in the axial direction, so that the relative displacement of the slider and the relative turning of the output member do not occur and the lift of the valve is retained.

Only a predetermined cylinder can be deactivated by combination of the variable valve mechanism of the present invention and the variable valve mechanism of the conventional example. Namely, a cylinder other than the predetermined cylinder is driven by the variable valve mechanism of the present invention, and the predetermined cylinder is driven by the variable valve mechanism of the conventional example, which makes it possible to deactivate only the predetermined cylinder. A specific form of this configuration is the following variable valve mechanism group.

The variable valve mechanism group of an internal combustion engine includes variable valve mechanisms for respective cylinders of the internal combustion engine, each variable valve mechanism including an input member and an output member which are swingably disposed on a same axis, so that the output member drives a valve when the input member is driven by a cam, and a slider that engages with the input member and the output member, so that when the slider is displaced relative to the input member and the output member in an axial direction as a longitudinal direction of the axis, the output member turns relative to the input member in a swing direction due to the engagement; and a displacement device that displaces the sliders of the variable valve mechanisms at a time, so that when the displacement device displaces the sliders at a time in an increasing direction, or toward one side in the axial direction, the relative displacement of the sliders occurs toward the one side in the axial direction and the relative turning of the output members occurs toward one side in the swing direction, whereby a lift of the valves is increased, and when the displacement device displaces the sliders at a time in a reducing direction, or toward the other side in the axial direction, the relative displacement of the sliders occurs toward the other side in the axial direction and the relative turning of the output members occurs toward the other side in the swing direction, whereby the lift of the valves is reduced. The variable valve mechanisms include a first variable valve mechanism provided for a cylinder other than a predetermined cylinder of the cylinders, and a second variable valve mechanism provided for the predetermined cylinder. The first variable valve mechanism is brought into a variable state when the slider is placed in a normal range located on an increasing direction side with respect to a predetermined boundary position, and is brought into a lift retaining state when the slider is placed in an idle running range located on a reducing direction side with respect to the boundary position. The variable state is a state where even when the slider is displaced in the axial direction, the input member and the output member are not displaced together with the slider in the axial direction, so that the relative displacement of the slider and the relative turning of the output member occur and the lift of the valve is changed. The lift retaining state is a state where when the slider is displaced in the axial direction, the input member and the output member are displaced together with the slider in the axial direction, so that the relative displacement of the slider and the relative turning of the output member do not occur and the lift of the valve is retained. The second variable valve mechanism is brought into the variable state regardless of whether the slider is placed in the normal range or in the idle running range. When each slider is placed in the normal range by the displacement device, the variable valve mechanism group is brought into a normal state where both the first and second variable valve mechanisms are in the variable state. When each slider is placed in a cylinder cutoff range, or a range where the lift of the second variable valve mechanism is zero, within the idle running range by the displacement device, the variable valve mechanism group is brought into a cylinder cutoff state where the first variable valve mechanism drives the valve and the second variable valve mechanism does not drive the valve.

Advantageous Effects of Invention

According to the present invention, only the predetermined cylinder can be deactivated.

BRIEF DESCRIPTION OF DRAWINGS

FIG. 5A shows the variable valve mechanism group with the sliders displaced in an increasing direction within the normal range, and FIG. 5B shows the variable valve mechanism group with the sliders displaced in a reducing direction within the normal range to the boundary position;

FIG. 6B shows the variable valve mechanism group with the sliders displaced in the increasing direction within the idle running range to the boundary position, and FIG. 6C shows the variable valve mechanism group with the sliders displaced in the reducing direction within the idle running range so that the lift of a second variable valve mechanism is reduced to zero;

DESCRIPTION OF EMBODIMENTS

Figure 1:
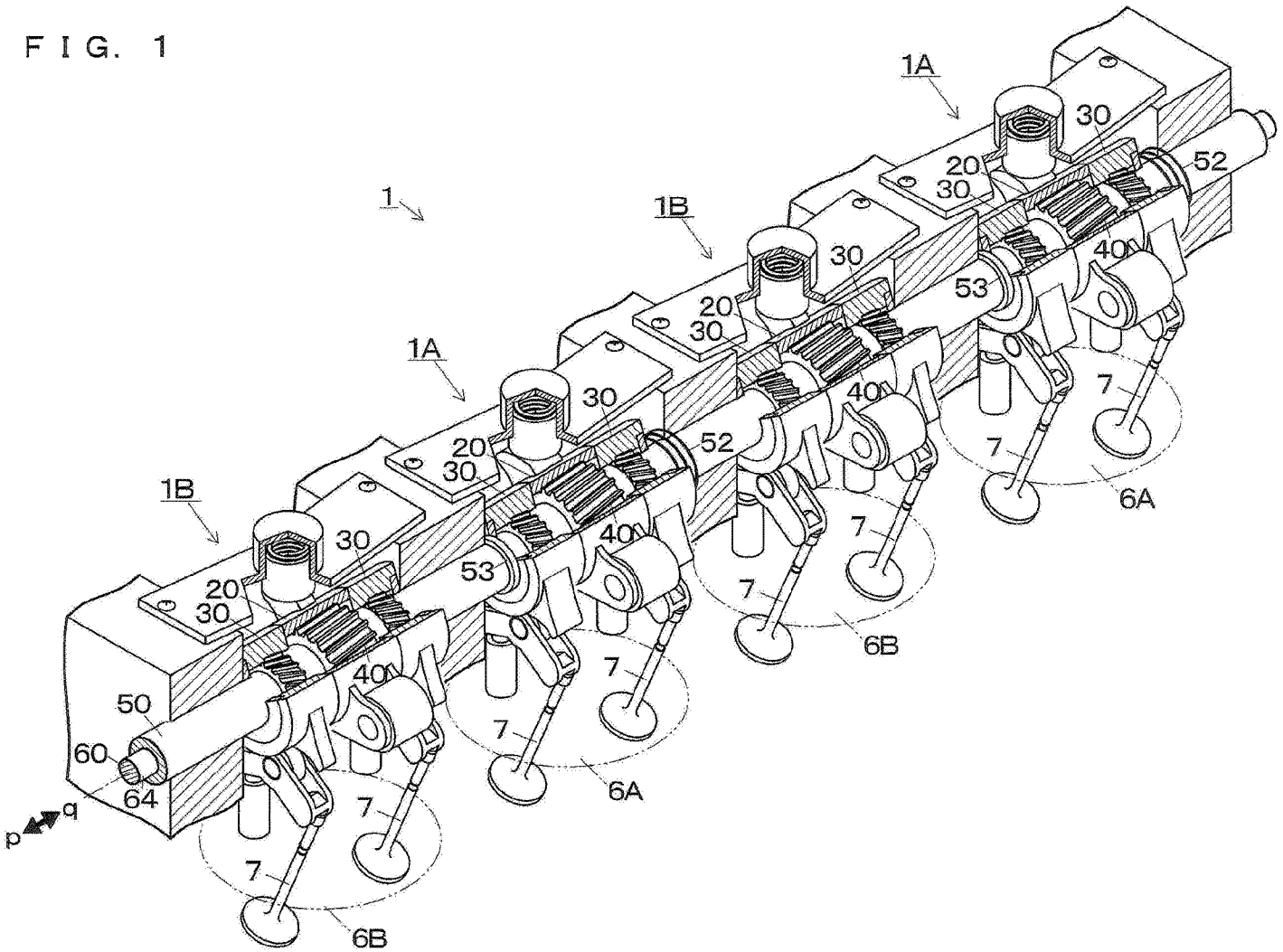
FIG. 1 is a perspective view of a variable valve mechanism group according to an embodiment.

The variable valve mechanism (the first variable valve mechanism) of the present invention may be in the following forms (i), (ii) although a specific form of the variable valve mechanism (the first variable valve mechanism) of the present invention is not particularly limited to them. It is preferable that the variable valve mechanism (the first variable valve mechanism) of the present invention be in the form (ii) in terms of ease of implementation.

(i) The variable valve mechanism includes a support shaft that is not displaced together with the slider in the axial direction even when the slider is displaced in the axial direction. The input member and the output member are swingably supported by the support shaft. The variable state is the state where the input member and the output member are not displaced together with the slider in the axial direction even when the slider is displaced relative to the support shaft in the axial direction. The lift retaining state is the state where the input member and the output member are displaced together with the slider in the axial direction when the slider is displaced relative to the support shaft in the axial direction.

(ii) The variable valve mechanism includes a support shaft. The input member and the output member are swingably supported by the support shaft so as to be displaced together with the support shaft in the axial direction. The variable state is a state where the support shaft is not displaced together with the slider in the axial direction even when the slider is displaced in the axial direction. The lift retaining state is a state where the support shaft is displaced together with the slider in the axial direction when the slider is displaced in the axial direction.

A more specific form of the form (ii) is as follows. The support shaft is a pipe-shaped shaft, has a long hole extending from an inner peripheral surface to an outer peripheral surface of the support shaft and extending in the axial direction, and is provided with a spring that biases the support shaft in the increasing direction. The displacement device includes a control shaft inserted through the support shaft. The slider engages with the control shaft via an engagement pin extending through the long hole such that the slider is displaced together with the control shaft in the axial direction. The variable state is a state where the support shaft is located at a predetermined basic position due to a biasing force of the spring, and the engagement pin does not contact an inner end face of the long hole on the reducing direction side even when the slider is displaced in the axial direction by the control shaft via the engagement pin. The lift retaining state is a state where the engagement pin contacts and presses the inner end face so that the support shaft is placed in a displacement range located on the reducing direction side with respect to the basic position against the biasing force of the spring, and the inner end face continues to be biased to contact the engagement pin due to the biasing force even when the slider is displaced in the axial direction by the control shaft via the engagement pin.

The input member and the output member engage with the slider in the following forms (1) to (3) although the engagement of the input member and the output member with the slider is not particularly limited to them.

(1) The input member engages with the slider by meshing of helical splines that are twisted in one direction, namely helical splines that are slanted toward one side in the swing direction as the splines extend in the increasing direction. The output member engages with the slider by meshing of helical splines that are twisted in the other direction, namely helical splines that are slanted toward the one side in the swing direction as the splines extend in the reducing direction.

(2) One of the input member and the output member engages with the slider by meshing of straight splines that extend straight in the axial direction. The other of the input member and the output member engages with the slider by meshing of helical splines that are slanted toward one side in the swing direction as the splines extend toward one side in the axial direction.

(3) One of the input member and the output member engages with the slider by meshing of straight splines that extend straight in the axial direction. The other of the input member and the output member has a slanted surface that is slanted toward one side in the swing direction as the surface extends toward one side in the axial direction, and the slider is in contact with the slanted surface.

An embodiment of the present invention will be described below. The present invention is not limited to the configuration of the embodiment and may be modified as appropriate without departing from the spirit and scope of the invention.

Embodiment

A variable valve mechanism group 1 of an embodiment shown in FIGS. 1 to 7 is a mechanism that drives valves 7 of a plurality of cylinders 6A, 6B of an internal combustion engine. A valve spring, not shown, is attached to each valve 7. Each valve spring biases a corresponding one of the valves 7 in a direction in which the valve 7 is closed. The variable valve mechanism group 1 includes first variable valve mechanisms 1A and second variable valve mechanisms 1B.

[First Variable Valve Mechanism 1A]

Figure 2:
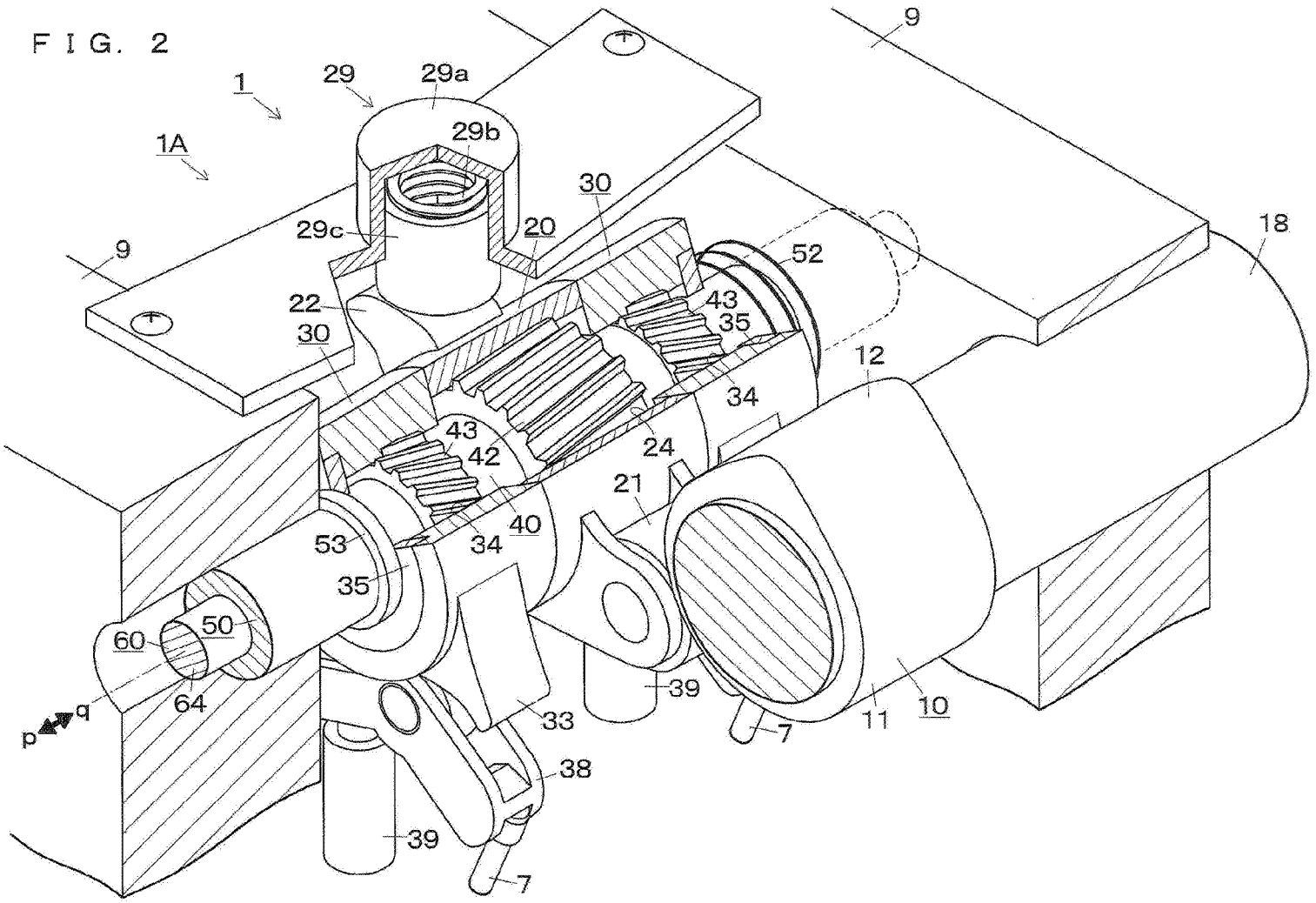
FIG. 2 is a perspective view of a first variable valve mechanism of the variable valve mechanism group.
Figure 3B:
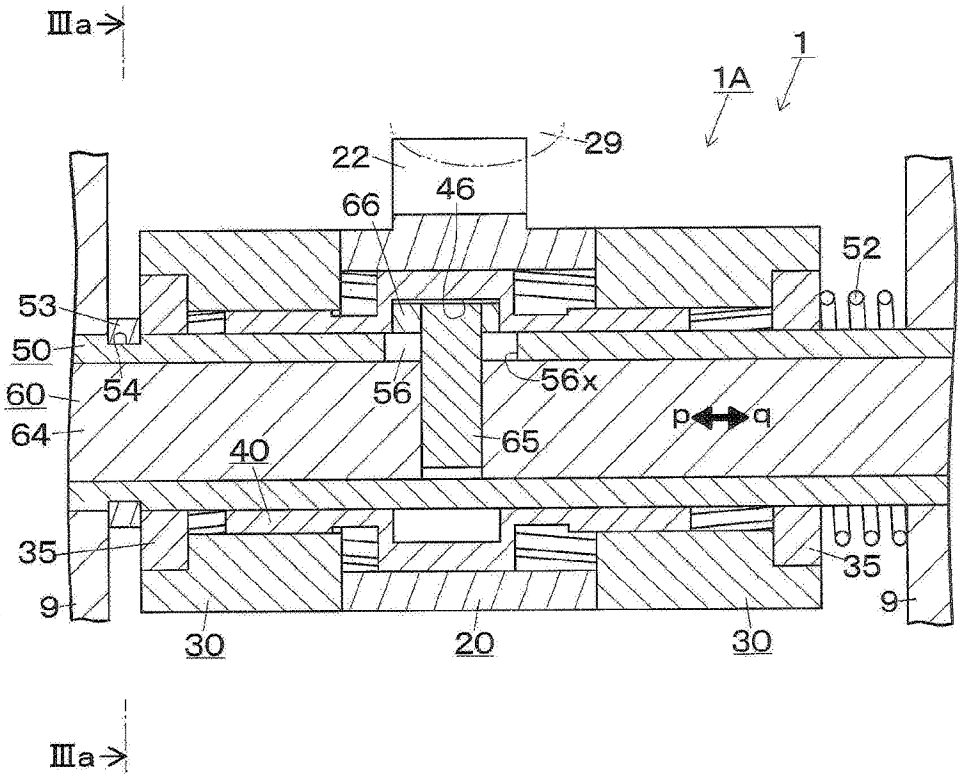
FIG. 3B is a front sectional view of the first variable valve mechanism taken along line IIIb-IIIb in FIG. 3A.
Figure 3A:
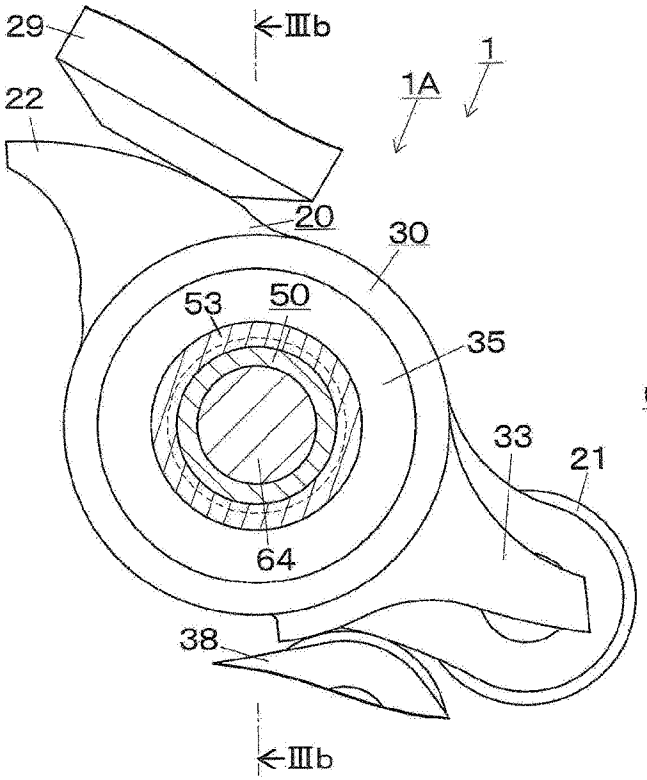
FIG. 3A is a side sectional view of the first variable valve mechanism taken along line IIIa-IIIa in FIG. 3B.

The first variable valve mechanisms 1A shown in FIGS. 2, 3A, 3B, etc. are provided for the cylinders 6A other than the predetermined cylinders 6B, and change the valve lift and the operation angle (hereinafter referred to as the "lift etc.") according to the operating condition of the internal combustion engine. The first variable valve mechanisms 1A each include a cam 10, an input member 20, output members 30, a slider 40, a support shaft 50, and a displacement device 60. In the following description, the longitudinal direction of the support shaft 50 is referred to as the "axial direction p, q," one direction of the axial direction p, q is referred to as the "increasing direction p," and the other axial direction is referred to as the "reducing direction q."

[Cam 10]

The cam 10 is disposed so as to protrude from a camshaft 18 extending in the axial direction p, q. The camshaft 18 is a common shaft for the first and second variable valve mechanisms 1A, 1B. A plurality of cam housings 9 are disposed side by side at intervals in the axial direction p, q in a cylinder head of the internal combustion engine. The camshaft 18 extends through the plurality of cam housings 9 in the axial direction p, q and is thus supported by the cam housings 9. The camshaft 18 rotates according to rotation of the internal combustion engine. Specifically, the camshaft 18 makes one full rotation for every two full rotations of the internal combustion engine. The cam 10 includes a base circle portion 11 having a circular section, and a nose 12 protruding from the base circle portion 11.

[Input Member 20]

The input member 20 is fitted on the support shaft 50 with the slider 40 interposed therebetween. The input member 20 is thus swingably supported by the support shaft 50. The input member 20 swings when driven by the cam 10.

Specifically, the input member 20 has input portion-side helical splines 24 on its inner peripheral surface. The input portion-side helical splines 24 are twisted in one direction. Namely, the input portion-side helical splines 24 are slanted toward one side (the lift direction) in the swing direction as the input portion-side helical splines 24 extend in the increasing direction p. The input member 20 has at its distal end a roller 21 that contacts the cam 10. The input member 20 further has a projection 22 at its rear end. A lost motion mechanism 29 contacts the projection 22. The lost motion mechanism 29 is a mechanism that biases the projection 22 of the input member 20 toward the other side (in the return direction) in the swing direction to bias the roller 21 so that the cam 10 follows the roller 21. The lost motion mechanism 29 includes a body 29*a*, a lifter 29*c*, and a lost motion spring 29*b* interposed between the body 29*a* and the lifter 29*c*.

[Output Members 30]

The output members 30 are comprised of one output member 30 disposed on the increasing direction p side with respect to the input member 20 and the other output member 30 disposed on the reducing direction q side with respect to the input member 20. The output members 30 are fitted on the support shaft 50 with the slider 40 interposed therebetween. The output members 30 are thus swingably supported by the support shaft 50 on the same axis as the input member 20. When the input member 20 is driven by the cam 10, the output members 30 swing together with the input member 20 to drive the valves 7.

Specifically, each output member 30 has output portion-side helical splines 34 on its inner peripheral surface. The output portion-side helical splines 34 are twisted in the other direction. Namely, the output portion-side helical splines 34 are slanted toward the one side (the lift direction) in the swing direction as the output portion-side helical splines 34 extend in the reducing direction q. Each output member 30 has its distal end a nose 33 that presses the valve 7. Each output member 30 drives the valve 7 by the nose 33 via a rocker arm 38. The rocker arm 38 is swingably supported by a lash adjuster 39. Each output member 30 has an end plate 35 at its opposite end from the input member 20. The end plate 35 is a separate member from the body of the output member 30.

[Slider 40]

The slider 40 is a cylindrical member. The slider 40 is fitted on the support shaft 50 so that the slider 40 is allowed to be displaced relative to the support shaft 50 in the axial direction p, q and is also allowed to swing relative to the support shaft 50 in the circumferential direction. The slider 40 has an engagement groove 46 in its inner peripheral surface. The engagement groove 46 extends in the circumferential direction (the swing direction) of the slider 40.

The input member 20 and the output members 30 are fitted on the slider 40. The slider 40 engages with the input member 20 and the output members 30 by meshing of helical splines. Specifically, the slider 40 has input helical splines 42 and output helical splines 43 on its outer peripheral surface. The input helical splines 42 mesh with the input portion-side helical splines 24, and the output helical splines 43 mesh with the output portion-side helical splines 34. Accordingly, when the slider 40 is displaced relative to the input member 20 and the output members 30 in the axial direction p, q, the output members 30 turn relative to the input member 20 in the swing direction due to meshing of the helical splines with the slider 40.

[Support Shaft 50]

The support shaft 50 is a common pipe-shaped shaft for the first and second variable valve mechanisms 1A, 1B. The support shaft 50 extends through the plurality of cam housings 9 in the axial direction p, q. The support shaft 50 is thus supported such that it can be displaced in the axial direction p, q. As described above, the support shaft 50 supports the input member 20 and the output members 30 of each variable valve mechanism 1A, 1B via the slider 40 such that the input member 20 and the output members 30 can swing.

A spring 52 is interposed between the output member 30 of each variable valve mechanism 1A on the reducing direction q side and the cam housing 9 adjoining this output member 30. The spring 52 biases an end face of the output member 30 on the reducing direction q side (the end plate 35) in the increasing direction p to bias the input member 20 and the output members 30 in the increasing direction p.

A receiving member 53 is disposed between the output member 30 of each variable valve mechanism 1A on the increasing direction p side and the cam housing 9 adjoining this output member 30. The receiving member 53 is a C-ring. The support shaft 50 has a fitting groove 54 formed in its outer peripheral surface so as to extend in the circumferential direction. The receiving member 53 is fitted in the fitting groove 54. The receiving member 53 is thus attached so as to be displaced together with the support shaft 50 in the axial direction p, q. An end face of the output member 30 on the increasing direction p side (the end plate 35) is biased toward the receiving member 53 by the spring 52.

The spring 52 and the receiving member 53 thus engage the input member 20 and the output members 30 with the support shaft 50 so that the input member 20 and the output members 30 are displaced together with the support shaft 50 in the axial direction p, q.

The spring 52 also biases the support shaft 50 in the increasing direction p via the input member 20, the output members 30, and the receiving member 53. By contacting the receiving member 53, the cam housing 9 adjoining the receiving member 53 serves as a stopper that inhibits the support shaft 50 from being displaced in the increasing direction p beyond a predetermined basic position O. When no external force is applied in the reducing direction q, the support shaft 50 is therefore located at the basic position O due to the biasing force of the spring 52. When an external force is applied in the reducing direction q, the spring 52 is compressed and the support shaft 50 is therefore placed in a displacement range V located on the reducing direction q side with respect to the basic position O.

The support shaft 50 has one long hole 56 for each of the first and second variable valve mechanisms 1A, 1B. The long holes 56 extend from the inner peripheral surface to the outer peripheral surface of the support shaft 50 and extend in the axial direction p, q.

[Displacement Device 60]

The displacement device 60 is a common device for the first and second variable valve mechanisms 1A, 1B. The displacement device 60 displaces the sliders 40 of the first and second variable valve mechanisms 1A, 1B at a time in the axial direction p, q.

Specifically, when the displacement device 60 displaces the sliders 40 at a time in the increasing direction p, the relative displacement (the displacement of each slider 40 relative to the input member 20 and the output members 30 in the axial direction p, q) occurs toward one side in the axial direction p, q and the relative turning (the turning of the output members 30 relative to the input member 20 in the swing direction) occurs toward one side in the swing direction, whereby the lift etc. of the valves 7 is increased. When the displacement device 60 displaces the sliders 40 at a time in the reducing direction q, the relative displacement occurs toward the other side in the axial direction p, q and the relative turning occurs toward the other side in the swing direction, whereby the lift etc. of the valves 7 is reduced.

Specifically, the displacement device 60 includes a control shaft 64 that displaces the sliders 40 at a time in the axial direction p, q. The control shaft 64 is disposed inside the support shaft 50. Engagement pins 65 are attached to the control shaft 64 so as to extend through the long holes 56. Each engagement pin 65 engages with the engagement groove 46 of a corresponding one of the sliders 40 via a bush 66. Each slider 40 thus engages with the control shaft 64 via the engagement pin 65 and the bush 66 so as to be displaced together with the control shaft 64 in the axial direction p, q and to be allowed to swing relative to the control shaft 64 in the circumferential direction.

[Overall Configuration]

Figure 5A:
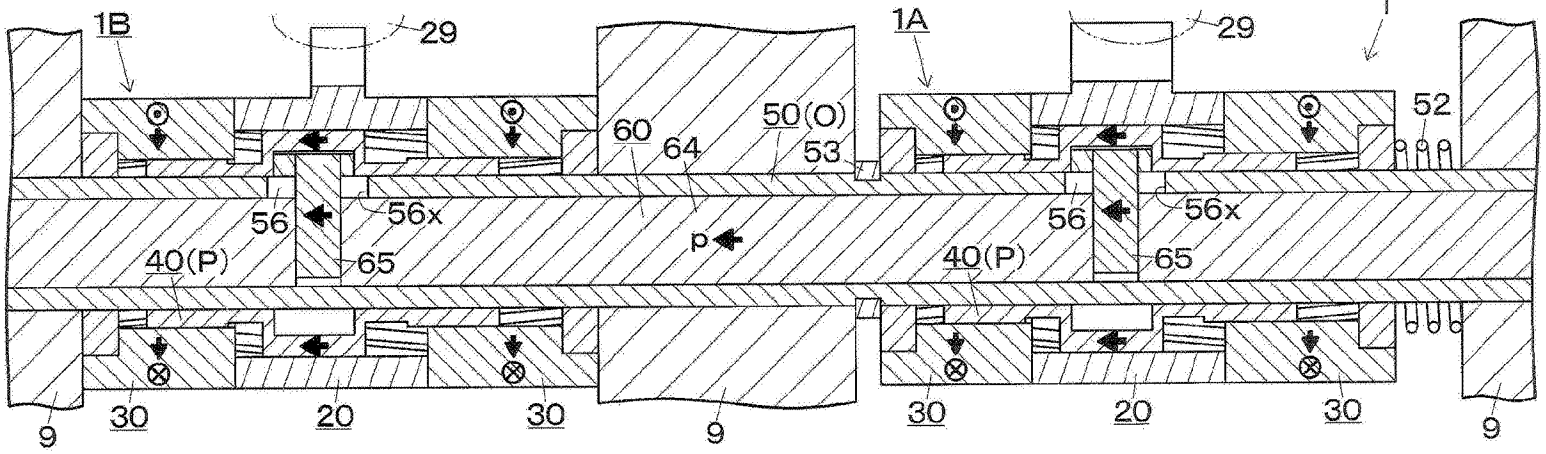
FIGS. 5A and 5B are front sectional views of the variable valve mechanism group with sliders located in a normal range or at a boundary position, where
Figure 5B:
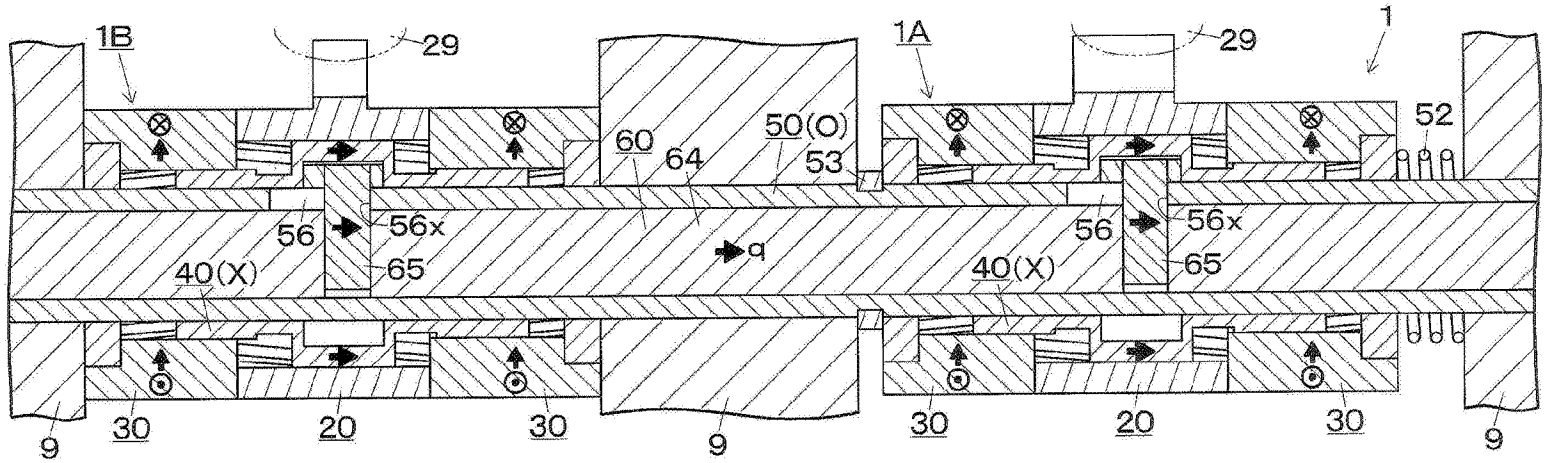

As shown in FIG. 5A, the first variable valve mechanism 1A is brought into a variable state when the slider 40 is placed in a normal range P located on the increasing direction p side with respect to a predetermined boundary position X by the control shaft 64. When the first variable valve mechanism 1A is in the variable state, the support shaft 50 is biased toward the cam housing 9 on the increasing direction p side due to the biasing force of the spring 52 and is located at the basic position O. Even when the slider 40 is displaced in the axial direction p, q by the control shaft 64 via the engagement pin 65, the engagement pin 65 does not contact an inner end face 56*x* of the long hole 56 on the reducing direction q side.

Accordingly, even when the slider 40 is displaced in the axial direction p, q by the control shaft 64 via the engagement pin 65, the support shaft 50, the input member 20, and the output members 30 are not displaced together with the slider 40 in the axial direction p, q. The slider 40 is therefore displaced relative to the input member 20 and the output members 30 in the axial direction p, q. The output members 30 thus turn relative to the input member 20 in the swing direction due to meshing of the helical splines with the slider 40. The lift etc. of the valves 7 is changed accordingly.

Figure 6B:
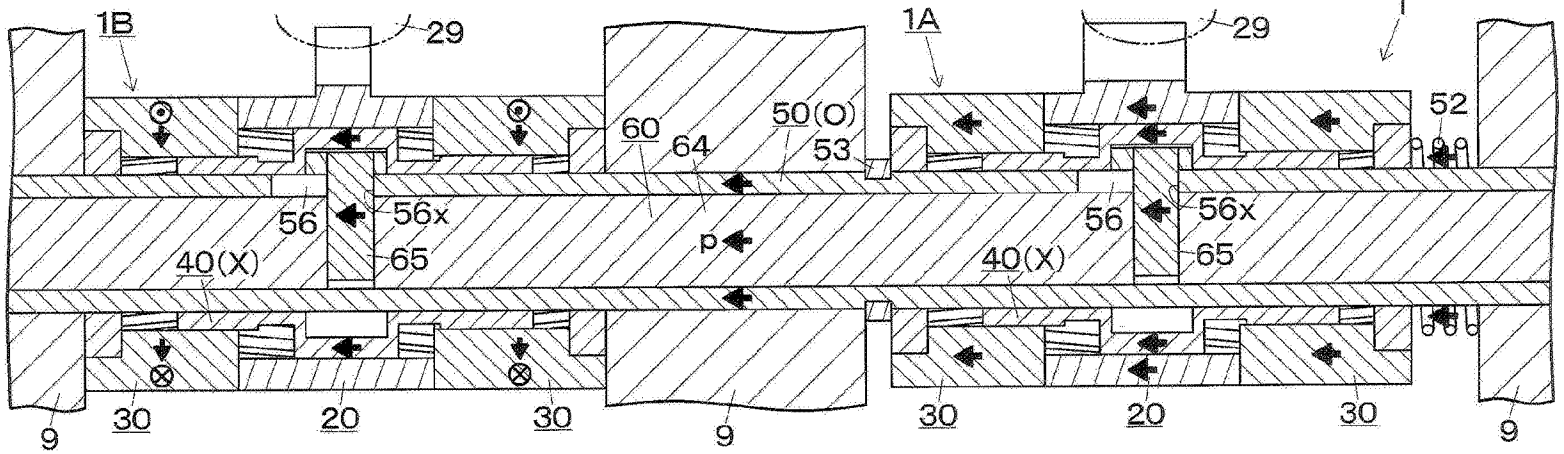
FIGS. 6B and 6C are front sectional views of the variable valve mechanism group with the sliders located in an idle running range or at the boundary position, where
Figure 6C:
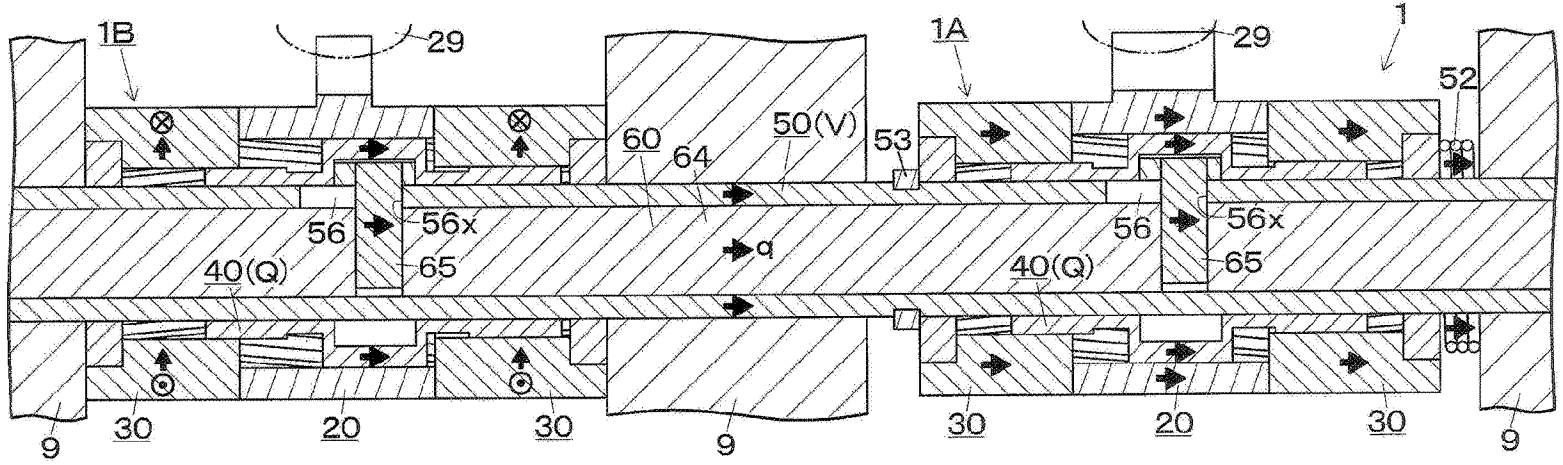
Figure 7:
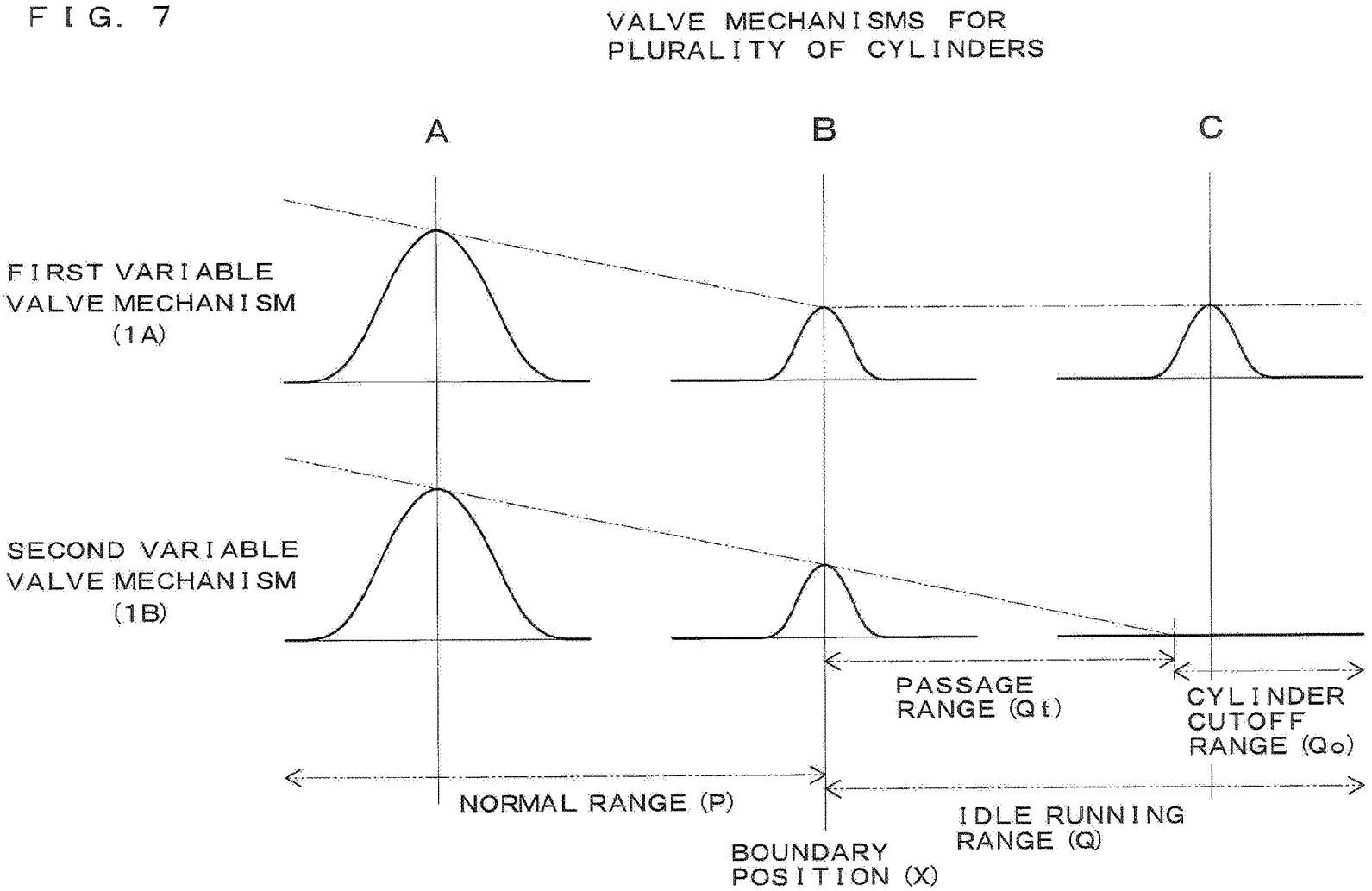
FIG. 7 are graphs showing how the lift of the variable valve mechanism group changes, where Graph A shows the lift in the state of FIG. 5A, Graph B shows the lift in the state of FIGS. 5B and 6B, and Graph C shows the lift in the state of FIG. 6C.

As shown in FIG. 6C, the first variable valve mechanism 1A is brought into a lift retaining state when the slider 40 is placed in an idle running range Q located on the reducing direction q side with respect to the boundary position X by the control shaft 64. When the first variable valve mechanism 1A is in the lift retaining state, the engagement pin 65 contacts and presses the inner end face 56*x* of the long hole 56 so that the support shaft 50 is placed in the displacement range V against the biasing force of the spring 52. Even when the slider 40 is displaced in the axial direction p, q by the control shaft 64 via the engagement pin 65, the inner end face 56*x* of the long hole 56 continues to be biased to contact the engagement pin 65 due to the biasing force of the spring 52. The support shaft 50 is therefore displaced together with the engagement pin 65 in the axial direction p, q.

Accordingly, when the slider 40 is displaced in the axial direction p, q by the control shaft 64 via the engagement pin 65, the support shaft 50, the input member 20, and the output members 30 are displaced together with the slider 40 in the axial direction p, q. The slider 40 therefore is not displaced relative to the input member 20 and the output members 30 in the axial direction p, q. The output members 30 thus do not turn relative to the input member 20 in the swing direction due to meshing of the helical splines with the slider 40. The lift etc. of the valves 7 is retained accordingly.

[Second Variable Valve Mechanism 1B]

Figure 4:
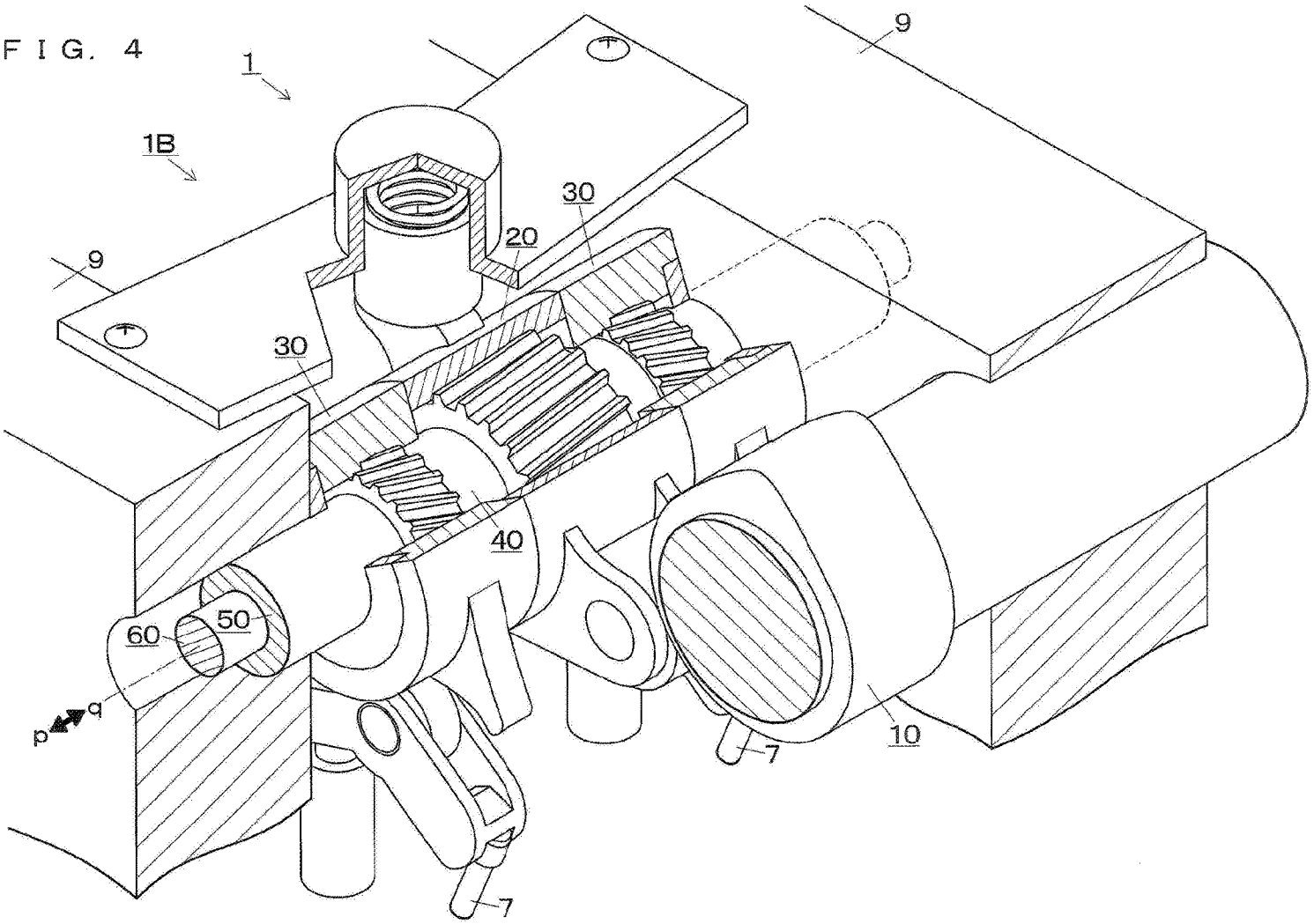
FIG. 4 is a perspective view of a second variable valve mechanism of the variable valve mechanism group.

The second variable valve mechanisms 1B shown in FIG. 4 etc. are provided for the predetermined cylinders 6B. Each second variable valve mechanism 1B is similar to the first variable valve mechanism 1A except for the following point.

The second variable valve mechanism 1B does not have the spring 52 and the receiving member 53. The respective opposite end faces of the output members 30 from the input member 20 (the end plates 35) contact the cam housings 9 adjoining the output members 30 (directly or via a shim). Accordingly, even when the support shaft 50 is displaced together with the control shaft 64 in the axial direction p, q, the input member 20 and the output members 30 are not displaced together with the support shaft 50 in the axial direction p, q.

The second variable valve mechanism 1B is therefore brought into the variable state regardless of whether the slider 40 is placed in the normal range P as shown in FIG. 5A or in the idle running range Q as shown in FIG. 6C. However, the mechanism of the variable state that is attained when the slider 40 is placed in the idle running range Q is slightly different from that of the variable state described above. In the variable state that is attained when the slider 40 is placed in the idle running range Q, if the slider 40 is displaced in the axial direction p, q by the control shaft 64 via the engagement pin 65, the support shaft 50 is displaced together with the slider 40 in the axial direction p, q, but the input member 20 and the output members 30 are not displaced together with the slider 40 and the support shaft 50 in the axial direction p, q. Therefore, the relative displacement and the relative turning described above occur, and the lift etc. of the valves 7 is changed accordingly.

[Variable Valve Mechanism Group 1]

The variable valve mechanism group 1 including the first and second variable valve mechanisms 1A, 1B switches the drive state of the valve 7 of each cylinder 6A, 6B as follows.

The variable valve mechanism group 1 is brought into a normal state when each slider 40 is placed in the normal range P by the control shaft 64 as shown in FIG. 5A. The normal state is the state where all of the first and second variable valve mechanisms 1A, 1B are in the variable state, as shown in Graph A in FIG. 7.

The variable valve mechanism group 1 is brought into a cylinder cutoff state when each slider 40 is placed in a cylinder cutoff range Qo within the idle running range Q by the control shaft 64, as shown in FIG. 6C. The cylinder cutoff range Qo is the range where the lift of each of the second variable valve mechanisms 1B is zero. The cylinder cutoff state is the state where the first variable valve mechanisms 1A drive the valves 7 and the second variable valve mechanisms 1B do not drive the valves 7, as shown in Graph C in FIG. 7. The range between the boundary position X and the cylinder cutoff range Qo in the idle running range Q is a passage range Qt where the sliders 40 are actively stopped and are not used.

According to the variable valve mechanism group 1 of the present embodiment, only the predetermined cylinders 6B (the second variable valve mechanisms 1B) can be deactivated by bringing the variable valve mechanism group 1 into the cylinder cutoff state.

For example, the present embodiment can be modified as follows.

[Modification]

Figure 8:
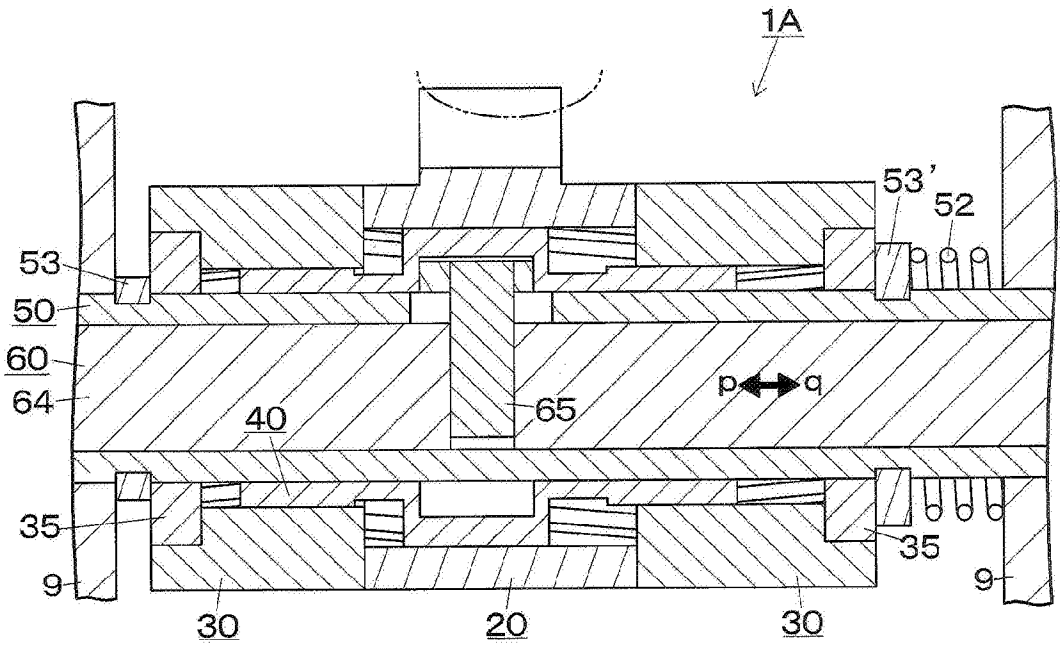
FIG. 8 is a side sectional view of a first variable valve mechanism of the variable valve mechanism group according to a modification.
Figure 9:
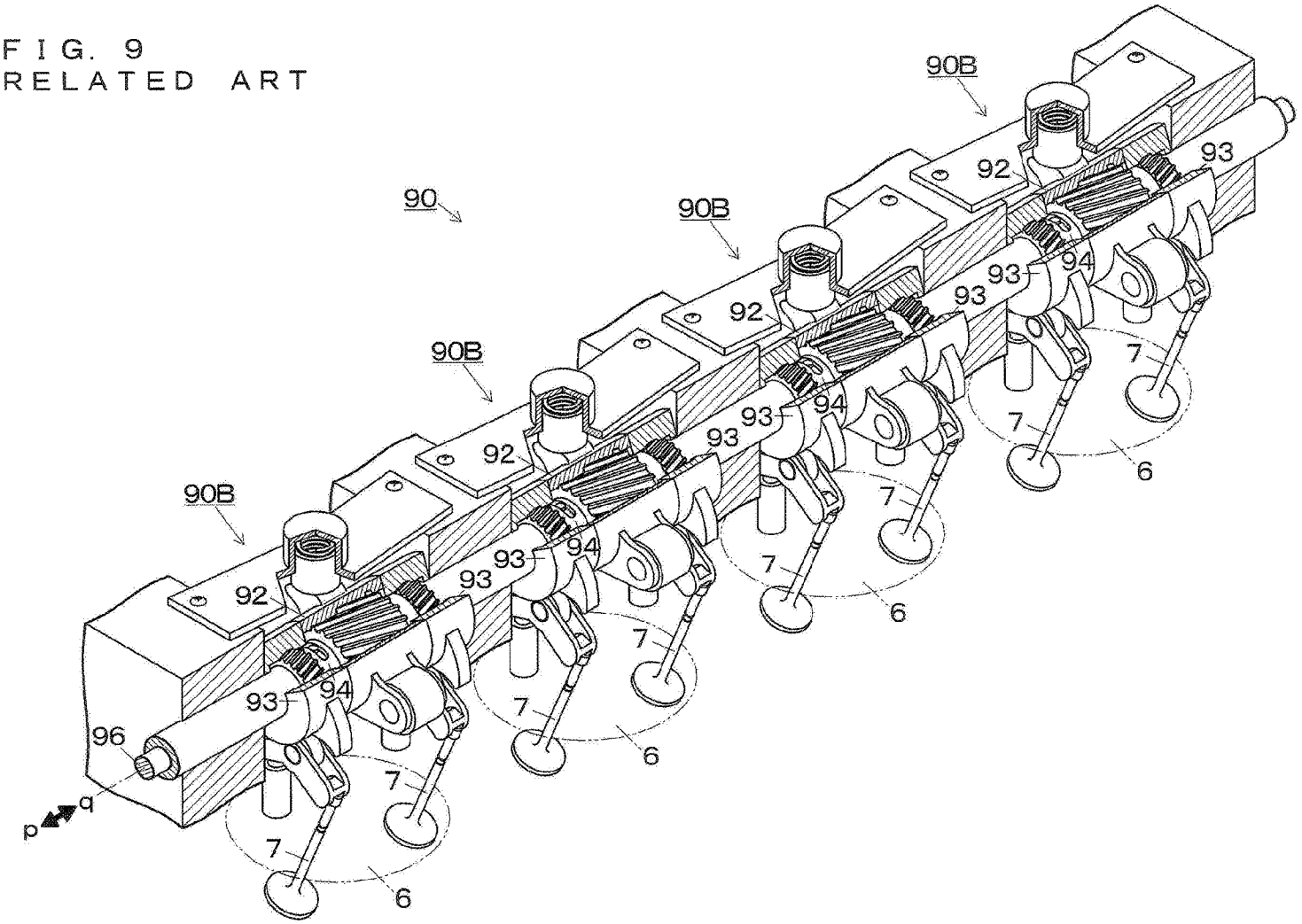
FIG. 9 RELATED ART
FIG. 9 is a perspective view of a variable valve mechanism group of a conventional example.

As shown in FIG. 8, a second receiving member 53' may be attached to the support shaft 50 so as to be displaced together with the support shaft 50 in the axial direction p, q. The second receiving member 53' is a member that contacts an end face of the output member 30 on the reducing direction q side. The second receiving member 53' may be biased by the spring 52 instead of biasing the end face of the output member 30 on the reducing direction q side (the end plate 35) by the spring 52.

REFERENCE SIGNS LIST

1 Variable Valve Mechanism Group
1A First Variable Valve Mechanism
1B Second Variable Valve Mechanism
6A Cylinder Other Than Predetermined Cylinder
6B Predetermined Cylinder
7 Valve
10 Cam
20 Input Member
30 Output Member
40 Slider
50 Support Shaft
52 Spring
56 Long Hole
56*x* Inner End Face of Long Hole on Reducing Direction Side
60 Displacement Device
64 Control Shaft
65 Engagement Pin
p Increasing Direction (One Direction of Axial Direction)
q Reducing Direction (Other Direction of Axial Direction)
X Boundary Position
P Normal Range
Q Idle Running Range
Qo Cylinder Cutoff Range
O Basic Position
V Displacement Range

The invention claimed is:

1. A variable valve mechanism of an internal combustion engine, the variable valve mechanism comprising:

an input member and an output member which are swingably disposed on a same axis, so that the output member drives a valve when the input member is driven by a cam;

a slider that engages with the input member and the output member, so that when the slider is displaced relative to the input member and the output member in an axial direction as a longitudinal direction of the axis, the output member turns relative to the input member in a swing direction due to the engagement;

a displacement device that displaces the slider, so that when the displacement device displaces the slider in an increasing direction, or toward one side in the axial direction, a relative displacement of the slider occurs toward the one side in the axial direction and a relative turning of the output member occurs toward one side in the swing direction, whereby a lift of the valve is increased, and when the displacement device displaces the slider in a reducing direction, or toward an other side in the axial direction, the relative displacement of the slider occurs toward the other side in the axial direction and the relative turning of the output member occurs toward the other side in the swing direction, whereby the lift of the valve is reduced; and a support shaft, wherein the input member and the output member are swingably supported by the support shaft so as to be displaced together with the support shaft in the axial direction, wherein the variable valve mechanism is brought into a variable state when the slider is placed in a normal range located on an increasing direction side with respect to a predetermined boundary position, and is brought into a lift retaining state when the slider is placed in an idle running range located on a reducing direction side with respect to the boundary position, wherein the variable state includes a state where when the slider is displaced in the axial direction, the input member, the output member, and the support shaft are not displaced together with the slider in the axial direction, so that the relative displacement of the slider and the relative turning of the output member occur and the lift of the valve is changed, wherein the lift retaining state includes a state where when the slider is displaced in the axial direction, the input member, the output member, and the support shaft are displaced together with the slider in the axial direction, so that the relative displacement of the slider and the relative turning of the output member do not occur and the lift of the valve is retained, wherein the support shaft includes a pipe-shaped shaft, has a long hole extending from an inner peripheral surface to an outer peripheral surface of the support shaft and extending in the axial direction, and is provided with a spring that biases the support shaft in the increasing direction, wherein the displacement device includes a control shaft inserted through the support shaft, and the slider engages with the control shaft via an engagement pin extending through the long hole such that the slider is displaced together with the control shaft in the axial direction, wherein the variable state includes a state where the support shaft is located at a predetermined basic position due to a biasing force of the spring, and the engagement pin does not contact an inner end face of the long hole on the reducing direction side when the slider is displaced in the axial direction by the control shaft via the engagement pin, and wherein the lift retaining state includes a state where the engagement pin contacts and presses the inner end face so that the support shaft is placed in a displacement range located on the reducing direction side with respect to the basic position against the biasing force of the spring, and the inner end face continues to be biased to contact the engagement pin due to the biasing force when the slider is displaced in the axial direction by the control shaft via the engagement pin.

2. The variable valve mechanism of the internal combustion engine according to claim 1, wherein the input member engages with the slider by meshing of helical splines, twisted in one direction, that are slanted toward one side in the swing direction as the splines extend in the increasing direction, and wherein the output member engages with the slider by meshing of helical splines, twisted in an other direction, that are slanted toward the one side in the swing direction as the splines extend in the reducing direction.

3. A variable valve mechanism of an internal combustion engine, the variable valve mechanism comprising:

an input member and an output member which are swingably disposed on a same axis, so that the output member drives a valve when the input member is driven by a cam;

a slider that engages with the input member and the output member, so that when the slider is displaced relative to the input member and the output member in an axial direction as a longitudinal direction of the axis, the output member turns relative to the input member in a swing direction due to the engagement;

a displacement device that displaces the slider, so that when the displacement device displaces the slider in an increasing direction, or toward one side in the axial direction, a relative displacement of the slider occurs toward the one side in the axial direction and a relative turning of the output member occurs toward one side in the swing direction, whereby a lift of the valve is increased, and when the displacement device displaces the slider in a reducing direction, or toward an other side in the axial direction, the relative displacement of the slider occurs toward the other side in the axial direction and the relative turning of the output member occurs toward the other side in the swing direction, whereby the lift of the valve is reduced; and a support shaft, wherein the input member and the output member are swingably supported by the support shaft so as to be displaced together with the support shaft in the axial direction, wherein the variable valve mechanism is brought into a variable state when the slider is placed in a normal range located on an increasing direction side with respect to a predetermined boundary position, and is brought into a lift retaining state when the slider is placed in an idle running range located on a reducing direction side with respect to the boundary position, wherein the variable state includes a state where when the slider is displaced in the axial direction, the input member, the output member, and the support shaft are not displaced together with the slider in the axial direction, so that the relative displacement of the slider and the relative turning of the output member occur and the lift of the valve is changed, wherein the lift retaining state includes a state where when the slider is displaced in the axial direction, the input member, the output member, and the support shaft are displaced together with the slider in the axial direction, so that the relative displacement of the slider and the relative turning of the output member do not occur and the lift of the valve is retained, wherein the support shaft extends through a plurality of cam housings in the axial direction and is supported by the cam housings, wherein a gap is formed between the output member on the reducing direction side and the cam housing adjoining the output member, and wherein, when the variable valve mechanism is in the lift retaining state, the input member and the output member are configured to be displaced in the axial direction by the gap.

4. The variable valve mechanism of an internal combustion engine according to claim 3, wherein the input member engages with the slider by meshing of helical splines, twisted in one direction, that are slanted toward one side in the swing direction as the splines extend in the increasing direction, and wherein the output member engages with the slider by meshing of helical splines, twisted in an other direction, that are slanted toward the one side in the swing direction as the splines extend in the reducing direction.

5. The variable valve mechanism of an internal combustion engine according to claim 3, wherein the displacement device includes a control shaft inserted through the support shaft, and the slider engages with the control shaft such that the slider is displaced together with the control shaft in the axial direction, wherein the variable state includes a state where the support shaft is not displaced together with the slider in the axial direction when the slider is displaced in the axial direction by the control shaft, and wherein the lift retaining state includes a state where the support shaft is displaced together with the slider in the axial direction when the slider is displaced in the axial direction by the control shaft.

6. A variable valve mechanism of an internal combustion engine, the variable valve mechanism comprising:

an input member and an output member which are swingably disposed on a same axis, so that the output member drives a valve when the input member is driven by a cam;

a slider that engages with the input member and the output member, so that when the slider is displaced relative to the input member and the output member in an axial direction as a longitudinal direction of the axis, the output member turns relative to the input member in a swing direction due to the engagement; and a displacement device that displaces the slider, so that when the displacement device displaces the slider in an increasing direction, or toward one side in the axial direction, a relative displacement of the slider occurs toward the one side in the axial direction and a relative turning of the output member occurs toward one side in the swing direction, whereby a lift of the valve is increased, and when the displacement device displaces the slider in a reducing direction, or toward an other side in the axial direction, the relative displacement of the slider occurs toward the other side in the axial direction and the relative turning of the output member occurs toward the other side in the swing direction, whereby the lift of the valve is reduced, wherein the variable valve mechanism is brought into a variable state when the slider is placed in a normal range located on an increasing direction side with respect to a predetermined boundary position, and is brought into a lift retaining state when the slider is placed in an idle running range located on a reducing direction side with respect to the boundary position, wherein the variable state includes a state where when the slider is displaced in the axial direction, the input member and the output member are not displaced together with the slider in the axial direction, so that the relative displacement of the slider and the relative turning of the output member occur and the lift of the valve is changed, wherein the lift retaining state includes a state where when the slider is displaced in the axial direction, the input member and the output member are displaced together with the slider in the axial direction, so that the relative displacement of the slider and the relative turning of the output member do not occur and the lift of the valve is retained, wherein one of the input member and the output member engages with the slider by meshing of straight splines that extend straight in the axial direction, and wherein an other of the input member and the output member engages with the slider by meshing of helical splines that are slanted toward one side in the swing direction as the splines extend toward one side in the axial direction.

7. A variable valve mechanism of an internal combustion engine, the variable valve mechanism comprising:

an input member and an output member which are swingably disposed on a same axis, so that the output member drives a valve when the input member is driven by a cam;

a slider that engages with the input member and the output member, so that when the slider is displaced relative to the input member and the output member in an axial direction as a longitudinal direction of the axis, the output member turns relative to the input member in a swing direction due to the engagement; and a displacement device that displaces the slider, so that when the displacement device displaces the slider in an increasing direction, or toward one side in the axial direction, a relative displacement of the slider occurs toward the one side in the axial direction and a relative turning of the output member occurs toward one side in the swing direction, whereby a lift of the valve is increased, and when the displacement device displaces the slider in a reducing direction, or toward an other side in the axial direction, the relative displacement of the slider occurs toward the other side in the axial direction and the relative turning of the output member occurs toward the other side in the swing direction, whereby the lift of the valve is reduced, wherein the variable valve mechanism is brought into a variable state when the slider is placed in a normal range located on an increasing direction side with respect to a predetermined boundary position, and is brought into a lift retaining state when the slider is placed in an idle running range located on a reducing direction side with respect to the boundary position, wherein the variable state includes a state where when the slider is displaced in the axial direction, the input member and the output member are not displaced together with the slider in the axial direction, so that the relative displacement of the slider and the relative turning of the output member occur and the lift of the valve is changed, wherein the lift retaining state includes a state where when the slider is displaced in the axial direction, the input member and the output member are displaced together with the slider in the axial direction, so that the relative displacement of the slider and the relative turning of the output member do not occur and the lift of the valve is retained, wherein one of the input member and the output member engages with the slider by meshing of straight splines that extend straight in the axial direction, and wherein an other of the input member and the output member includes a slanted surface that is slanted toward one side in the swing direction as the surface extends toward one side in the axial direction, and the slider is in contact with the slanted surface.

8. A variable valve mechanism group of an internal combustion engine, the variable valve mechanism group comprising:

variable valve mechanisms for respective cylinders of the internal combustion engine, each variable valve mechanism including:

an input member and an output member which are swingably disposed on a same axis, so that the output member drives a valve when the input member is driven by a cam; and a slider that engages with the input member and the output member, so that when the slider is displaced relative to the input member and the output member in an axial direction as a longitudinal direction of the axis, the output member turns relative to the input member in a swing direction due to the engagement; and a displacement device that displaces the sliders of the variable valve mechanisms at a time, so that when the displacement device displaces the sliders at a time in an increasing direction, or toward one side in the axial direction, a relative displacement of the sliders occurs toward the one side in the axial direction and a relative turning of the output members occurs toward one side in the swing direction, whereby a lift of the valves is increased, and when the displacement device displaces the sliders at a time in a reducing direction, or toward an other side in the axial direction, the relative displacement of the sliders occurs toward the other side in the axial direction and the relative turning of the output members occurs toward the other side in the swing direction, whereby the lift of the valves is reduced, wherein the variable valve mechanisms include a first variable valve mechanism provided for a cylinder other than a predetermined cylinder of the cylinders, and a second variable valve mechanism provided for the predetermined cylinder, wherein the first variable valve mechanism is brought into a variable state when the slider is placed in a normal range located on an increasing direction side with respect to a predetermined boundary position, and is brought into a lift retaining state when the slider is placed in an idle running range located on a reducing direction side with respect to the boundary position, wherein the variable state includes a state where when the slider is displaced in the axial direction, the input member and the output member are not displaced together with the slider in the axial direction, so that the relative displacement of the slider and the relative turning of the output member occur and the lift of the valve is changed, wherein the lift retaining state includes a state where when the slider is displaced in the axial direction, the input member and the output member are displaced together with the slider in the axial direction, so that the relative displacement of the slider and the relative turning of the output member do not occur and the lift of the valve is retained, wherein the second variable valve mechanism is brought into the variable state regardless of whether the slider is placed in the normal range or in the idle running range, wherein, when each slider is placed in the normal range by the displacement device, the variable valve mechanism group is brought into a normal state where both the first and second variable valve mechanisms are in the variable state, and wherein, when each slider is placed in a cylinder cutoff range, or a range where the lift of the second variable valve mechanism is zero, within the idle running range by the displacement device, the variable valve mechanism group is brought into a cylinder cutoff state where the first variable valve mechanism drives the valve and the second variable valve mechanism does not drive the valve.

9. The variable valve mechanism group of an internal combustion engine according to claim 8, wherein the displacement device includes a control shaft inserted through the support shaft, and the slider engages with the control shaft such that the slider is displaced together with the control shaft in the axial direction, wherein the variable state of the first variable valve mechanism includes a state where the support shaft is not displaced together with the slider in the axial direction when the slider is displaced in the axial direction by the control shaft, and wherein the lift retaining state of the first variable valve mechanism includes a state where the support shaft is displaced together with the slider in the axial direction when the slider is displaced in the axial direction by the control shaft.

10. The variable valve mechanism group of an internal combustion engine according to claim 8, wherein the input member engages with the slider by meshing of helical splines, twisted in one direction, that are slanted toward one side in the swing direction as the splines extend in the increasing direction, and wherein the output member engages with the slider by meshing of helical splines, twisted in an other direction, that are slanted toward the one side in the swing direction as the splines extend in the reducing direction.

* * * * *